US006405562B1

(12) United States Patent
Zimet et al.

(10) Patent No.: US 6,405,562 B1
(45) Date of Patent: Jun. 18, 2002

(54) CUT GEM, IN PARTICULAR CUT DIAMOND

(75) Inventors: Eve Zimet; Nadine Schmidt, both of Zurich (CH)

(73) Assignee: Montblanc-Simplo GmbH, Hambourg (DE)

( * ) Notice: Subject to any disclaimer, the term of this patent is extended or adjusted under 35 U.S.C. 154(b) by 0 days.

(21) Appl. No.: 09/710,836

(22) Filed: Nov. 14, 2000

(30) Foreign Application Priority Data

Dec. 23, 1999 (CH) ..... 2370/99

(51) Int. Cl.[7] ..... A44C 17/00
(52) U.S. Cl. ..... 63/32; D11/89; D11/90
(58) Field of Search ..... 63/32; D11/89, D11/90

(56) References Cited

U.S. PATENT DOCUMENTS

| | | | | |
|---|---|---|---|---|
| 5,462,474 A | | 10/1995 | Hansen | |
| D384,592 S | * | 10/1997 | Siman-Tov et al. | D11/90 |
| D390,155 S | * | 2/1998 | Couture | D11/89 |
| D398,552 S | * | 9/1998 | Siman-Tov et al. | D11/90 |
| 5,882,786 A | * | 3/1999 | Nassau et al. | 63/32 X |
| D442,880 S | * | 5/2001 | Zimet et al. | D11/90 |
| D447,439 S | * | 9/2001 | Zimet et al. | D11/90 |

FOREIGN PATENT DOCUMENTS

| | | |
|---|---|---|
| CH | 684301 | 8/1994 |
| FR | 323618 | 3/1903 |
| GB | 1015389 | 12/1965 |

OTHER PUBLICATIONS

"5 Nouvelles Tailles Pour Le Diamant," La France Horlogère, Besancon, France, No. 497, Nov. 1, 1988, pp. 154–159.

* cited by examiner

*Primary Examiner*—Jack Lavinder
*Assistant Examiner*—Andrea Chop
(74) *Attorney, Agent, or Firm*—Young & Thompson

(57) ABSTRACT

The cut gem, in particular the diamond, has a predetermined number of cut facets in the crown (10) and in the pavilion about a central axis of geometric symmetry. The facets (25 to 27) are disposed about said axis of symmetry in a hexagonal arrangement. This geometric axis of symmetry preferably corresponds to one of the ternary crystallographic axes of the diamond. The girdle (12) separating the crown from the pavilion has a contour (20) of lobed shape with six rounded projecting portions and six rounded hollow portions (21, 22). The gem thus cut permits obtaining the original optical effects of brilliance and dispersion of light.

12 Claims, 4 Drawing Sheets

CUT GEM, IN PARTICULAR CUT DIAMOND

FIELD OF THE INVENTION

The present invention relates to a cut gem comprising a first predetermined number of facets cut in the crown and a second predetermined number of facets cut in the pavilion above a central geometric axis of symmetry.

BACKGROUND OF THE INVENTION

For many centuries, gems were cut roughly, in cabochon or in various often irregular shapes, with the only concern to give to the gem the greatest volume possible. These ancient stones often were dull, without brilliance, even when they were beautifully polished. At present, the cutting technique has greatly evolved. The cut is executed scientifically by observing the laws of crystalline optics so as to obtain the best yield of optical qualities for transparent gems. It is sought particularly to give to the stones maximum brilliance, which is the case when they reflect externally the greatest part of the light that they receive. On the other hand, diamond has a high dispersion of index of refraction as a function of the wavelength of the light. The strong dispersion is the origin of the fire the diamond displays. It is to be noted that a sheet with parallel surfaces cannot show fire, nor can a stone returning white light by simple reflection without the light being broken up by refraction. There is fire only if the light is broken by refractions and reflections on the polished facets of the cut diamond. There have thus been developed "brilliant" cuts that are more and more improved, as described for example in Swiss patent 684,301. These brilliant cuts have in general a fourway geometric axis of symmetry by placing the cut facets parallel to the generatrix of the cone which envelops them, that are four in number or multiples of four, such as eight stars, sixteen crown triangles and sixteen pavilion triangles. Diamonds thus cut return to the observer an image with a fourfold symmetry.

OBJECT OF THE INVENTION

It is the object of the present invention to create a new gem cut permitting obtaining the original optical effects and a differently designed shape, whilst maintaining the intensity of the brilliance and fire of the non-brilliant cuts.

SUMMARY OF THE INVENTION

The gem, in particular the diamond thus cut, returns toward the observer an image having a generally hexagonal symmetry and a play of reflections of light and different colorations like six-rayed stars in which the lobes return toward the observer chatoyant optical effects.

According to a preferred embodiment, the gem is constituted by diamond or a stone having an index of refraction and a dispersion substantially equal to those of diamond.

With these characteristics, there are obtained particularly important optical effects of light play.

Preferably, its central axis of geometric symmetry corresponds to one of the ternary crystallographic axes of symmetry of the diamond.

This characteristic permits obtaining the facilitated and certain cut of the table by cleaving the diamond on one of the faces of the octahedron. Moreover, the quality of the cut of the facets can thus be predetermined and carried out with high precision.

The invention also relates to a process for cutting a gem, in particular a diamond, characterized by the fact that first of all, all the facets of the crown and of the pavilion are cut, and that then the lobed periphery of the girdle is cut out by forming the lobes in six portions with rounded projections and six portions with rounded hollows.

BRIEF DESCRIPTION OF THE DRAWINGS

Other advantages will appear from the characteristics claimed in the dependent claims and by the description explaining the invention hereafter in greater detail with the help of the drawings which show schematically and by way of example two embodiments.

DETAILED DESCRIPTION OF THE INVENTION

Figure 1:
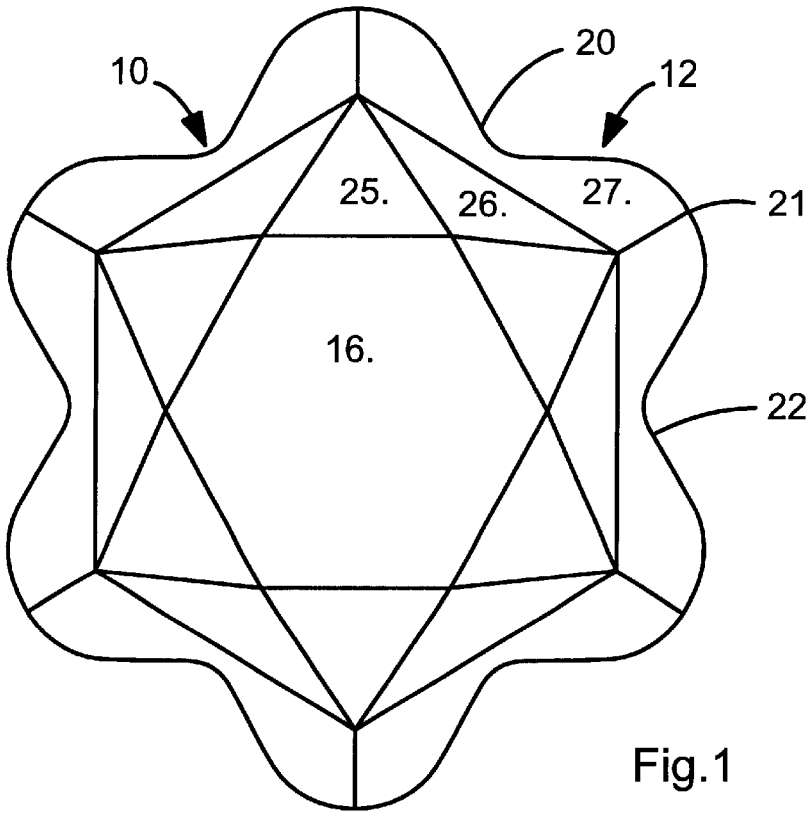
FIGS. 1, 2 and 3 are views from above, below and from the side, of a first embodiment.
Figure 2:
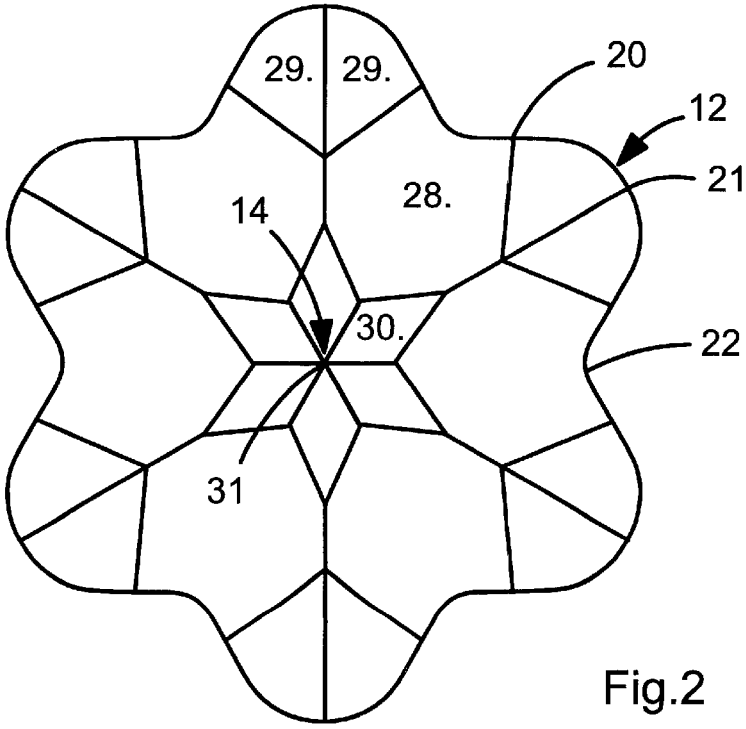
Figure 3:
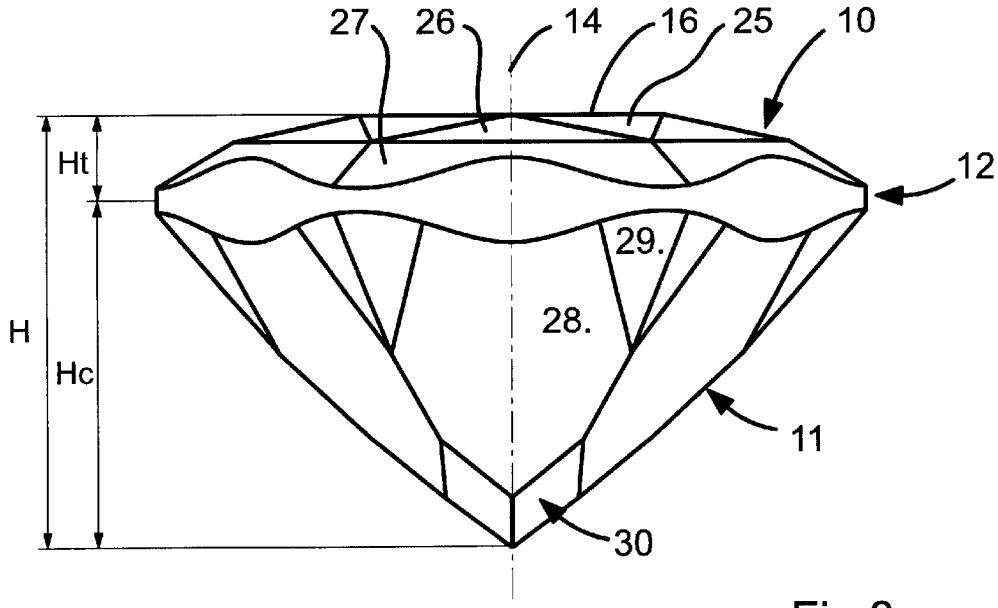

The cut gem shown in FIGS. 1–3 is a diamond and comprises a crown 10 and a pavilion 11 separated by a girdle 12. The geometric shape of the cut of this diamond has an axis 14 of hexagonal rotation as the principal element of symmetry. The facets of the cut are thus arranged about this axis in a hexagonal arrangement.

This axis of geometric symmetry corresponds preferably to one of the ternary chrystallographic axes of the crystalline structure of the diamond, if the geometric shape of the rough diamond to be cut permits this. The table 16 and the plane of the girdle 12 will thus be parallel to one of the facets of the octahedron of the rough diamond, which will permit obtaining positioning of the table 16 by cleavage of the rough diamond, avoiding careful sawing as is generally necessary when the table is perpendicular to one of the fourfold crystallographic axes of the diamond.

Figure 4:
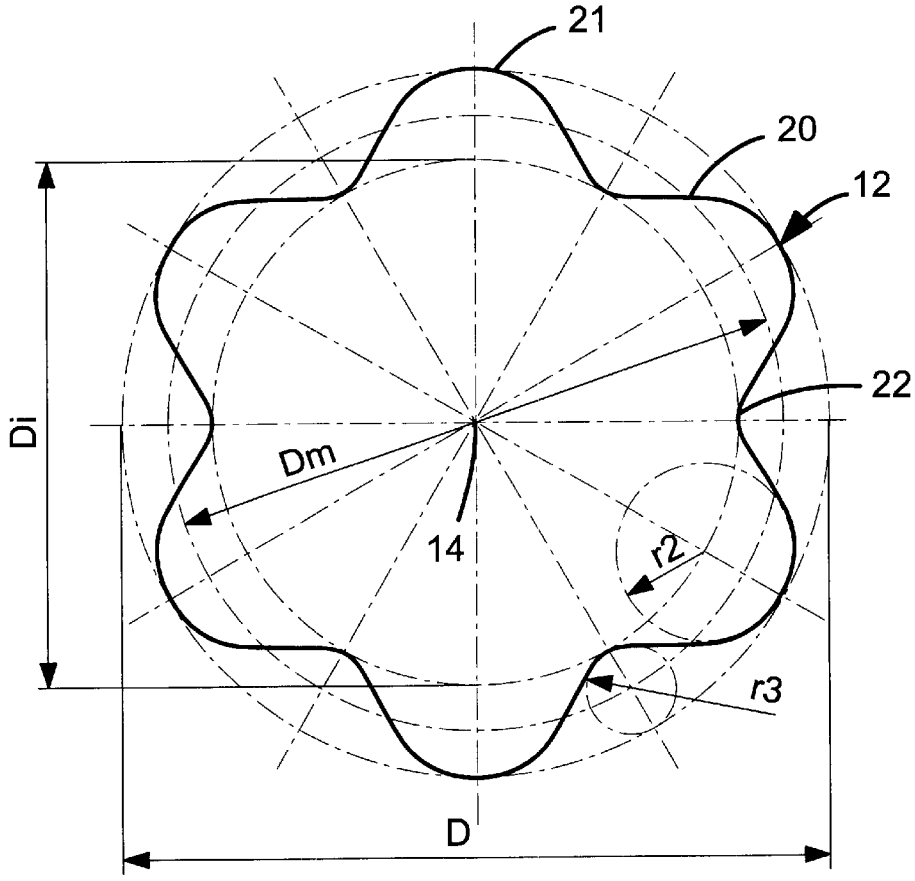
FIG. 4 shows certain characteristics of the external contour of the girdle of the first embodiment.

The contour 20 of the girdle 12, seen perpendicular to the hexagonal axis 14, as shown in FIG. 4, has a lobed shape with six rounded projecting portions 21 and six rounded hollow portions 22. Thus, the girdle 12 has a maximum external diameter D, a minimum internal diameter Di and a mean intermediate diameter Dm. The projecting portions 21 have a radius of curvature r2 which is substantially equal to 0.125D, whilst the radius of curvature r3 of the hollow portions 22 is substantially equal to 0.062D.

The crown 10 comprises a table 16 of hexagonal or substantially hexagonal shape, according to the precision of the cut. Six first triangular facets 25 each share one of their edges with an edge of the table. Six second facets 26 are interposed between the first facets and six third facets 27 share one of their edges with an edge of the second facets 26 and are connected to the girdle 12.

The pavilion 11 has six fourth facets 28 and twelve facets 29 disposed adjacent the girdle on opposite sides of the edges separating the fourth facets, and six sixth facets 30 disposed adjacent the culet 31 partially between two adjacent fourth facets 28.

The second, third and fourth facets 26, 27, 28, as well as the hollow portions 22 of the girdle, are arranged according to a first identical angular position about the hexagonal geometric axis, whilst the first and sixth facets 25, 30 and the projecting portions 21 are in a second angular position offset 300 from the first angular position. There is thus a predetermined correspondence between the facets of the crown, those of the pavilion, and the contour of the girdle.

The height H of the cut gem, between its table and its culet, is preferably comprised between 0.55D and 0.75D, more preferably 0.6D. The height Ht of the crown above the plane of the girdle is preferably 0.13D, and the height Hc of the pavilion is preferably 0.47D. The first 25, respectively second 26, respectively third 27, respectively fourth 28 and respectively sixth facets 30 form angles comprising between 10° and 25°, respectively 10° and 25°, respectively 25° and 35°, respectively 35° to 55°, and respectively 25° to 35°.

Preferably, the third and fourth facets 27 and 28 on opposite sides of the girdle, form an angle of 30° and 42° with the plane of the girdle 12.

The process of cutting this gem comprises in the first instance obtaining the table, preferably by clevage parallel to one of the octahedral faces and then, after roughing out, cutting the different facets of the crown and the pavilion. Finally, the lobed contour of the star shape of the girdle 12 is cut out with its six projecting portions and six hollow portions. This cut is preferably made with the help of a laser cutting apparatus. The cut surfaces of the girdle 12 are then polished and cleaned until all traces of black carbonization due to laser burning have disappeared. The weight of the cut diamond maintains about 25 to 30% of the weight of the rough diamond; this cut therefore does not give a high yield. On the other hand, diamonds cut with this cut permit obtaining total internal reflections having a structure and shape of hexagonal and lobed images, which gives the gem new and original optical effects. This hexagonal symmetry, combined with total internal reflections on the facets of the pavilion and a differential reflection on the facets of the crown, permit obtaining remarkable and original fire because of its hexagonal distribution and the peripheral lobes.

Figure 5:
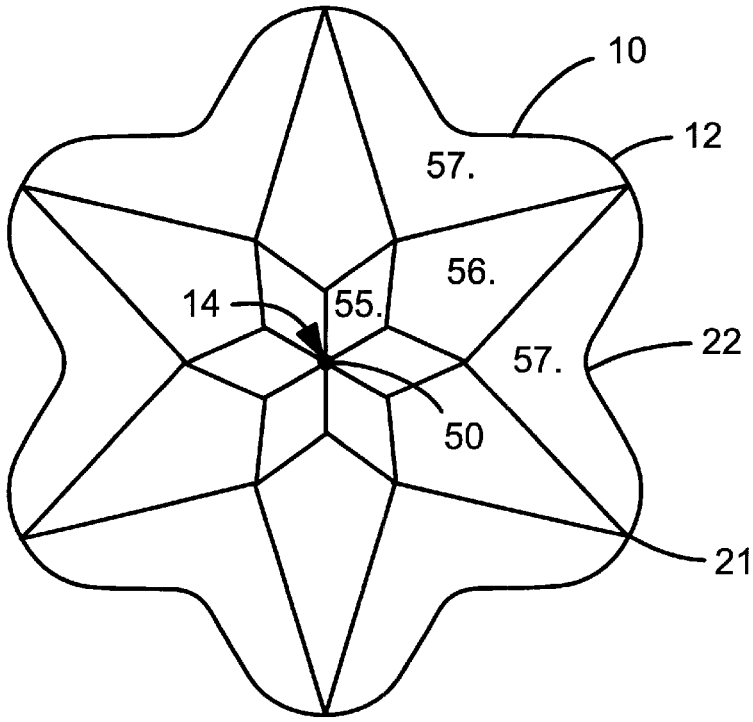
FIGS. 5, 6 and 7 are views from above, below and from the side, of a second embodiment.
Figure 6:
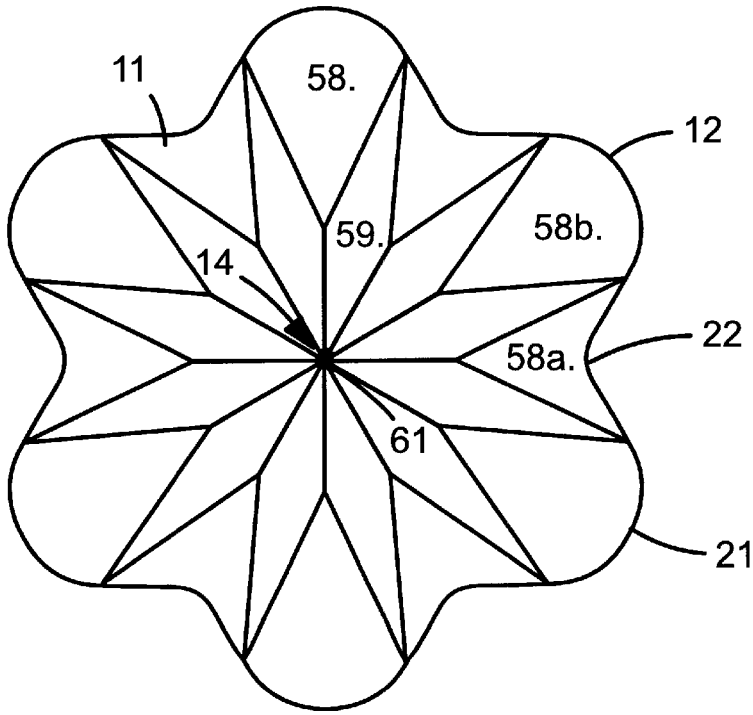
Figure 7:
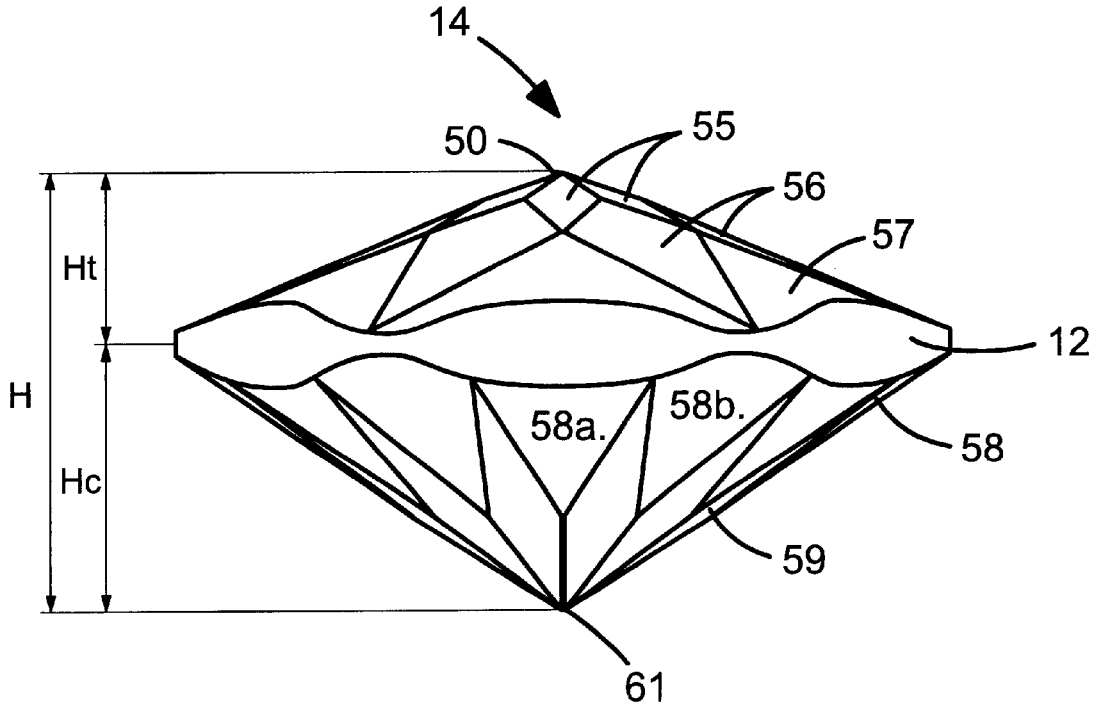

The second embodiment shown in FIGS. 5 to 7 also comprises a crown 10 and a pavilion 11 separated by a girdle 12. The ensemble also has a hexagonal geometric shape with a central hexagonal axis of symmetry 14 about which are arranged facets in a hexagonal symmetry. The axis of geometrical symmetry can preferably also correspond to one of the ternary axes of symmetry of the crystallographic structure of the diamond. The girdle 12 also has a lobed shape with six rounded projecting portions 21 and six rounded hollow portions 22 of which the radii of curvature can be similar to those of the first embodiment.

In this case, the crown 10 has, instead of a table, an apex 50 formed by six first triangular facets 55 arranged in a first angular position about the hexagonal geometric axis 14. Six second facets 56 are arranged in an intermediate position according to the second angular position offset 30° from the first angular position, and six third facets disposed adjacent the girdle according to the first angular position. The pavilion 12 has twelve fourth facets 58 arranged adjacent the girdle 12 and twelve fifth facets 59 forming the culet 61 and each disposed between two fourth facets in a position angularly offset by 15° relative to that of the fourth facets.

The hollow portions 22, the first and third facets 55, 57 and half 58*a* of the fourth facets are arranged according to the first angular position. The projecting portions 21, the second facets 56 and the other half 58*b* of the fourth facets are disposed according to the second angular position.

The height H between the apex 50 and the culet 61 is comprised between 0.5 and 0.75 times the external diameter D of the girdle 12. Preferably, this height H, the height Ht of the crown and the height Hc of the pavilion are 0.52D, 0.18D and 0.35D.

The first 55, respectively the second 56, respectively the third 57, respectively the fifth facets 59 form with the plane of the girdle angles comprised between 8° and 20°, respectively 20° and 27°, respectively 20° and 32°, respectively 30° to 50°. Preferably, the second and fifth facets 56 and 59 on opposite sides of the girdle form an angle of 23° and 34° with the plane of the girdle 12.

The cutting process is similar because the crown facets 10 and the pavilion facets 11 are first cut about the hexagonal axis 14, which preferably corresponds to the ternary crystallographic axis of the diamond, and because then the lobed periphery of the girdle is cut, preferably with a laser.

Of course the embodiments described above are not limiting and can be the subject of all desirable modifications within the scope defined by the claims. In particular, the cut according to the invention could also be carried out on other stones and gems having refractive index and dispersion similar or substantially equal to those of diamond. It may be desirable to change the angles of inclination of the facets taking account of the indices of refraction of the substitute stones. Thus, the angles of the facets could also be changed according to the shape of the rough stones. Other supplemental facets could be added.

What is claimed is:

1. A cut gem having a crown (10), a pavilion (11) and a girdle (12) and comprising a first predetermined number of facets (25 to 27; 55 to 57) cut in the crown (10) and a second predetermined number of facets (28, 29; 58, 59) cut in the pavilion (11) about a central geometric axis of symmetry, characterized by the fact that said crown facets and pavilion facets are disposed about said axis (14) of symmetry in a substantially hexagonal arrangement and by the fact that the girdle (12) separating the crown (10) and the pavilion (11) has a contour (20) of lobed shape with six convexly rounded projecting portions (21) and six concavely rounded hollow portions (22).

2. Gem according to claim 1, characterized by the fact that the gem is a stone having an index of refraction and a dispersion substantially equal to those of diamond.

3. Gem according to claim 2, characterized by the fact that said central geometric axis (14) of symmetry corresponds to one of the ternary crystallographic axes of symmetry of the diamond.

4. Gem according to claim 1, characterized by the fact that the projecting portions (21) of the girdle have a radius of curvature substantially equal to 0.125 times the external diameter (D) of the girdle (12) and by the fact that the hollow portions (22) of the girdle have a radius of curvature substantially equal to 0.062 times the external diameter (D) of the girdle (12).

5. A cut gem having a crown (10), a pavilion (11) and a girdle (12) and comprising a first predetermined number of facets (25 to 27; 55 to 57) cut in the crown (10) and a second predetermined number of facets (28, 29; 58, 59) cut in the pavilion (11) about a central geometric axis of symmetry, characterized by the fact that said crown facets and pavilion facets are disposed about said axis (14) of symmetry in a substantially hexagonal arrangement and by the fact that the crown (10) comprises a table (16) with a substantially hexagonal contour, and the first predetermined number of facets of the crown comprises at least six first triangular facets (25) each sharing one of their edges with an edge of the table, six second facets (26) interposed between the six first facets and six third facets (27) each sharing one of their edges with an edge of the second facets, and by the fact that the girdle (12) separating the crown (10) and the pavilion (11) has a contour (20) of lobed shape with six rounded projecting portions (21) and six rounded hollow portions (22).

6. Gem according to claim 4, further comprising a culet (31), characterized by the fact that the second predetermined number of facets of the pavilion (11) comprises at least six fourth facets (28) and twelve fifth facets (29) disposed adjacent the girdle on opposite sides of edges separating the fourth facets (28), and six sixth facets (30) disposed adjacent the culet (31) at least partially between two adjacent of the fourth facets (28).

7. Gem according to claim 6, characterized by the fact that the second, third and fourth facets (26, 27, 28) are arranged according to a first identical angular position about said geometric axis (14), by the fact that the six hollow portions (22) of the girdle are arranged according to this first angular position, whereas the first and sixth facets (25, 30) and the projecting portions (21) are arranged according to a second angular position offset by 30° from the first angular position.

8. Gem according to claim 7, characterized by the fact that the gem has a height (H) between the table (16) and the culet (31) is comprised between 0.55 and 0.75 times the external diameter (D) of the girdle (12), that the first (25), respectively second (26), respectively third (27), respectively fourth (28) and respectively sixth facets (30) form angles comprised between 10° and 25°, respectively 10° and 25°, respectively 25° and 35°, respectively 35° to 55° and respectively 25° to 35° with the plane of the girdle (12).

9. A cut gem having a crown (10), a pavilion (11) and a girdle (12) and comprising a first predetermined number of facets (25 to 27; 55 to 57) cut in the crown (10) and a second predetermined number of facets (28, 29; 58, 59) cut in the pavilion (11) about a central geometric axis of symmetry, characterized by the fact that said crown facets and pavilion facets are disposed about said axis (14) of symmetry in a substantially hexagonal arrangement and by the fact that the crown (10) comprises an apex (50) and, forming this apex, the first predetermined number of facets of the crown comprises six first facets (55) arranged according to a first angular position about said geometric axis, six second facets (56) arranged in an intermediate position according to a second angular position offset 30° from the first facets (55) and six third facets (57) arranged adjacent the girdle (12) in the first angular position.

10. Gem according to claim 9, further comprising a culet (14), characterized by the fact that the second predetermined number of facets of the pavilion (11) comprises at least twelve fourth facets (58) arranged adjacent to the girdle (12) and twelve fifth facets (59) arranged adjacent to the culet (14), each partially between two fourth facets (58) in an angular position offset by 15° relative to these fourth facets (58).

11. Gem according to claim 10, characterized by the fact that the hollow portions (22), the first and third facets (55, 57) and half the fourth facets (55*a*) are arranged according to said first angular position and the projecting portions (21), the second facets (56) and the other half (55*b*) of the fourth facets are arranged according to the second angular position.

12. Gem according to claim 11, characterized by the fact that the gem has a height (H) between the apex (50) and the culet (61) which is comprised between 0.5 and 0.75 times the external diameter (D) of the girdle (12), that said first (55), respectively second (56), respectively third (57), respectively fifth (59) facets form angles comprised between 8° and 20°, respectively 20° and 27°, respectively 20° and 32°, respectively 30° to 50° with the plane of the girdle (12).

* * * * *